United States Patent [19]

Matsuzawa

[11] 3,996,852

[45] Dec. 14, 1976

[54] LINE PRINTER

[75] Inventor: Nobuyoshi Matsuzawa, Tokyo, Japan

[73] Assignee: Copal Company Limited, Tokyo, Japan

[22] Filed: Dec. 16, 1974

[21] Appl. No.: 533,295

[30] Foreign Application Priority Data

Dec. 20, 1973 Japan ..... 48-145232[U]

[52] U.S. Cl. ..... 101/93.31

[51] Int. Cl.[2] ..... B41J 9/36

[58] Field of Search ..... 101/93.28, 93.29, 93.3, 101/93.31, 93.32, 93.33, 93.48, 93.03

[56] References Cited

UNITED STATES PATENTS

| | | | |
|---|---|---|---|
| 2,893,313 | 7/1959 | Pekar et al. | 101/93.31 |
| 3,587,456 | 6/1971 | Jaensch | 101/93.31 |
| 3,673,956 | 7/1972 | Huber et al. | 101/93.31 |
| 3,726,213 | 4/1973 | Herbert | 101/93.03 X |
| 3,823,667 | 7/1974 | Babler | 101/93.31 |
| 3,832,942 | 9/1974 | Murayoshi | 101/93.31 |

*Primary Examiner*—Edward M. Coven
*Attorney, Agent, or Firm*—Oblon, Fisher, Spivak, McClelland & Maier

[57] ABSTRACT

The line printer comprises a main frame; a type-carrying drum mounted in said main frame for selective rotation and a plurality of rows of the type supported in the periphery of said drum; a plurality of typewriting hammers pivoted to said main frame adjacent to said drum for effecting a typewriting operation in cooperation with the drum; a subframe assembly adjustably secured to said main frame, said subframe assembly comprising a subframe adjustably secured to said main frame, a plurality of selector levers pivoted to the subframe by means of a common lever shaft in association with said hammers, respectively, a plurality of drive levers pivoted to said selector levers respectively, said drive levers being so spring-loaded that when said selector levers are pivoted in one direction against spring force, the drive levers engage said cam shaft to be operated thereby so as to engage said hammers to cause the hammers to strike against said drum for effecting a typewriting operation in cooperation with the drum, but the drive levers are normally subjected to spring force so as to bias said selector levers in the direction opposite to said one direction, a plurality of selector magnets provided on said subframe adjacent to said selector levers and a plurality of iron pieces connected to said selector levers, respectively, to be attracted by said magnets so as to pivot the selector levers in said one direction, respectively; and a typewriting operation control circuit for selectively energizing said magnets so as to effect the typewriting operation.

1 Claim, 2 Drawing Figures

LINE PRINTER

BACKGROUND OF THE INVENTION

This invention relates to a line printer including a plurality of rows of type corresponding to columns of letters to be typewritten and a plurality of typewriting hammers and more particularly, to an improved line printer incorporating therein a letter selection mechanism which can be easily assembled and produced at less expense.

There have been proposed and practically employed a number of line printers of the above-type and any of the prior art line printers has the disadvantages that it is required that the selector magnets for selectively operating the typewriting hammers under the control of a letter selection control circuit, the selector levers and the drive levers are individually mounted and adjusted on the main body or frame one after another and that since the main frame and these components are incorporated deep into the main frame, the mounting of these components is the time consuming operation requiring a relatively large number of troublesome steps.

SUMMARY OF THE INVENTION

The object of the present invention is to provide an improved line printer which can eliminate the above-mentioned disadvantages inherent in the prior art line printers and which can be assembled in a quite simple manner.

The above and other objects and attendant advantages of the present invention will be more readily apparent to those skilled in the art from a reading of the following detailed description in conjunction with the accompanying drawing which shows one preferred embodiment of the present invention for illustration purpose only, but not for limiting the scope of the same in any way.

DETAILED DESCRIPTION OF THE PREFERRED EMBODIMENT

Figure 1:
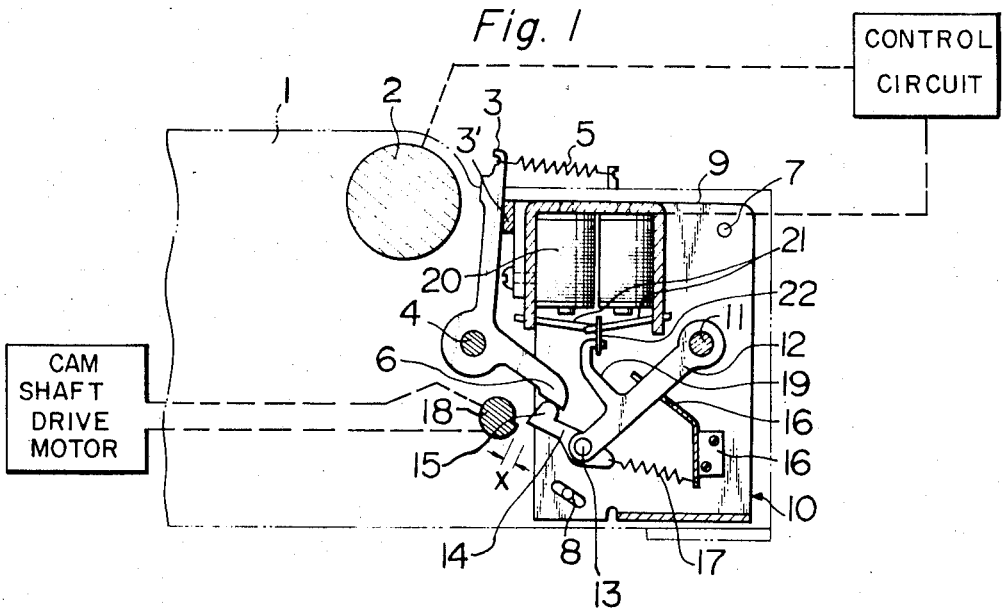
FIG. 1 is a fragmentary schematic view in side elevation of essential parts of one preferred embodiment of line printer constructed in accordance with the present invention.

The present invention will be now described referring to the accompanying drawings and more particularly, to FIG. 1 thereof. In FIG. 1, the line printer generally has a main body or frame 1 in which a type-carrying drum 2 having a predetermined number of rows of type supported in the periphery thereof is rotatably mounted and the drum is adapted to be selectively rotated through a predetermined angular distance in response to a signal from an operation control circuit for effecting a predetermined type-writing operation in the manner as will be described hereinafter.

A plurality of typewriting hammers 3 are pivoted to the main body or frame 1 by means of a common shaft 4 in opposition to the drum 2 for cooperating with the latter in the typewriting operation in the manner as will be described hereinafter. The number of the hammers correspond to the number of rows of type on the drum and consequently, each hammer is associated with each of the rows of type. The typewriting hammers 3 are selectively actuated by the above-mentioned control circuit in the manner as will be described hereinafter to strike against and effect a typewriting on a sheet of paper which is positioned in the space between the rows of hammers and the drum in cooperation with the latter. Springs 5 are anchored at one end to the upper ends of the hammers respectively and the other ends of the springs are anchored to the main frame 1 so as to normally bias the hammers in the clockwise direction as seen in FIG. 1 or away from the drum 2 to thereby hold the hammers against an abutment 3′ secured to the main frame 1.

The typewriting hammers 3 are integrally formed with arms 6, respectively, which extend rearwardly and downwardly from the respectively associated hammers.

Figure 2:
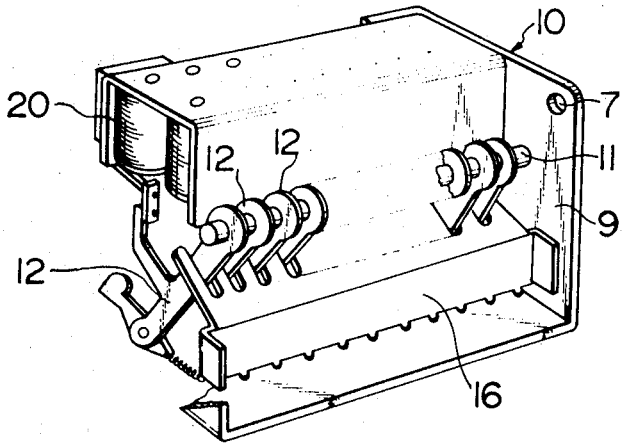
FIG. 2 is a fragmentary perspective view on the enlarged scale of the subframe including the type selection mechanism which constitutes the feature of the line printer of the invention showing portion of said type selection mechanism broken away.

As one feature of the present invention, a subframe 10 having a pair of spaced side plates 9 (only one of the side plates is shown in FIG. 2) each having an upper mounting hole 7 adjacent to one corner of the associated side plate (the upper right-hand corner as seen in FIG. 1) and a lower mounting hole 8 in the form of a slot at the corner diagonal with respect to the first-mentioned corner or the lower left-hand corner as seen in FIG. 1 are adjustably secured to the main frame 1 by means of screws. As will be understood from the slot form of the mounting holes 8 in the side plates 9 of the subframe 10, by moving the screws associated with the holes 8 along the holes, the position of the subframe 10 relative to the main frame 1 can be adjusted within the range as indicated by the arrow X in FIG. 1.

A selector lever shaft 11 extends between and is secured at the opposite ends to the side plates 9 and a plurality of spaced selector levers 12 are pivoted on the shaft 11 in positions in alignment with the respective arms of the hammers 3, respectively and the other ends of the selector levers have drive levers 14 pivoted at their midpoints between the opposite ends thereto, respectively, by means of drive shafts 13, respectively. The other or free ends of the drive levers 14 are formed with laterally extending projections 15 respectively, for abutting against the arms 6 of the hammers 3, respectively, when the hammers are to be actuated in the manner as will be described hereinafter. The ends of the drive levers 14 remote from the projections 15 have drive lever springs 17 anchored thereto, respectively and the other ends of the springs are anchored to a lever guide 16 which has comb-like teeth and which is in turn secured to the subframe 10. The lever guide 16 serves to guide the levers 12 in the openings defined between the respectively adjacent teeth thereof and also to normally urge the drive levers 14 in the counter-clockwise direction and in consequence, the movement of the selector levers 12 in the counter-clockwise direction under the action of the springs 17 is arrested when the selector levers abut against the bottoms of the openings defined by the adjacent comb teeth of the guide 16.

When the selector levers 12 are in abutment against the bottoms of the openings in the guide 16, the projections 15 on the drive levers 14 are held in their retracted or disengaged position from a cam shaft 18 which is journalled in the main frame 1 and adapted to continuously rotate during the printing operation of the line printer in a conventional manner by means such as a driving motor. In the operation of the line printer, when one of the selector levers 12 is selectively pivoted in the clockwise direction by a selector magnet, as described later in response to a command signal from an operation control circuit for controlling the printing operation of the line printer, well known in the art (but not by the cam shaft 18) against the action of the spring 17 associated with the selector lever 12, the projection 15 on the drive lever 14 to which the lever spring 17 associated with the selected selector lever 12 is anchored is moved leftwardly to engage and to be pushed upwardly by the cam portion on the cam shaft 18 to thereby cause the pushed projection 15 to abut against the arm 6 of the typewriting hammer 3 associated with the drive lever 14 whose projection 15 has been pushed upwardly to thereby pivot the said typewriting hammer 3 in the counter-clockwise direction against the action of the spring 5 associated with the pivoted hammer 3 to strike against one selected type in one of the rows of type on the drum 2 which row of type is associated with the pivoted hammer 3 for effecting one typewriting operation on a paper sheet (not shown) interposed between the drum 2 and the pivoted hammer. At the initiation of the typewriting operation, the type-carrying drum 2 is rotated through a predetermined angular distance so as to present the selected type in the selected row of type to the typewriting position to be struck by the selected type-writing hammer 3 and then stopped and at the same time, the paper sheet is fed from a supply source (not shown) into the space between the drum and hammers and then stopped.

In order to selectively pivot the selector levers 12 in the clockwise direction, the selector levers are formed with hook arms 19, respectively, which project upwardly from the midpoints between the opposite ends of these selector levers 12, respectively and selector iron pieces 21 are respectively connected to the hook arms 19 by means of connector pieces 22, respectively. The iron pieces 21 are respectively adapted to be attracted by selector magnets 20 which are secured to the subframe 10 in association with the selector levers 12, respectively. Thus, when any one of the selector magnets 20 is energized by the command signal from the control circuit, the selector iron piece 21 associated with the energized selector magnet 20 is attracted thereby and in consequence, the hook arm 19 of the selector lever 12 associated with the energized magnet 20 is pulled upwardly so as to pivot the selector lever 12 in the counterclockwise direction which in turn moves the drive lever 14 associated with the pivoted selector lever 12 against the action of the spring 17 associated with the said selector lever until the said drive lever engages the cam shaft 18 at its free end where the projection 15 is formed whereupon the said projection 15 is pushed upwardly to strike against the arm 6 of the typewriting hammer 3 associated with the said drive lever 14 to thereby cause the hammer to effect the typewriting operation in the manner as mentioned hereinabove.

The selector magnets 20 are adapted to be selectively energized by the operation control circuit in synchronism with the angular position control of the drum 2 and the rotation of the cam shaft 18.

As mentioned hereinabove, according to the present invention, the subframe 10 is secured to the main frame 1 in such a manner that the position of the subframe can be adjusted relative to the main frame and the selector magnets 20 having the iron pieces 21 respectively, the selector levers 12 pivotally supporting the drive levers 14, respectively and the lever guide 16 are mounted on the subframe 10, before the subframe 10 is secured to the main frame 1, these components of the typewriting mechanism can be assembled to the subframe 10 and adjusted externally of the main frame 1 and thus, the handling of these components of the line printer typewriting mechanism is quite simple and the assembly of these components can be effected in a relatively small number of steps. Furthermore, in the mounting of the subframe 10 on the main frame 1, by the provision of the slot-type mounting holes 8 in the side plates 9 of the subframe 10 so that the position of the subframe 10 relative to the main frame 1 can be adjusted, it is only necessary to properly adjust the operation space defined between the cam shaft 18 and the projection 15 on each of the drive levers 14 or the advancing position of the projection 15 on each of the drive levers 14 and in consequence, the number of steps required in the assembling of the line printer is substantially reduced as compared with that required in the assembling of the conventional line printers in which all the components are mounted on the main frame one after another while adjusting them each time the individual components are mounted on the main frame and thus, the present invention provides a simpler and less expensive line printer.

While only one embodiment of the invention has been shown and described in detail, it will be understood that the same is for illustration purpose only and not to be taken as a definition of the invention, reference being had for the purpose to the appended claim.

I claim:

1. A line printer comprising:

a main frame;

a selectively rotatable type-carrying drum rotatably mounted in said main frame and having a plurality of rows of type in the periphery thereof corresponding to columns of letters to be printed;

a plurality of hammers corresponding in number to said rows of type being pivotably mounted to said main frame and positioned adjacent to and spaced from said periphery of said drum for effecting the printing operation;

a cam shaft journalled in said main frame and adapted to be continuously rotated during the printing operation by motor means;

a sub frame;

a plurality of selector levers pivoted at one end on a common selector lever shaft mounted in said sub frame, each being positioned in alignment with the respective hammers;

a plurality of drive levers pivoted at one end thereof to the other ends of said selector levers, respectively, and spring biasing means connected between said sub frame and said drive levers for urging said selector levers to pivot in one direction, said drive levers being disposed adjacent to said cam shaft such that when said selector levers are pivoted in the other direction against the biasing force of said spring biasing means, the other ends of said drive levers engage said cam shaft which, during rotation thereof, operates through a cam portion thereon to push said other ends of said drive levers into abutment with one end of said hammers so as to pivot the hammers to cause them to strike against the periphery of said drum;

a plurality of selector magnets provided in association with said selector levers, respectively;

a plurality of selector iron peices provided adjacent to said selector magnets, respectively, and connected to said selector levers to be attracted by the magnets when the magnets are energized whereby the selector levers are pivoted in said other direction; and a control circuit connected to said selector magnets for selectively energizing the selector magnets;

said selector magnets, said selector iron pieces, said selector lever shaft, said selector levers and said drive levers being mounted upon said sub frame which is formed as a separate member from said main frame, and said sub frame being adjustably secured to said main frame so that the position of the sub frame is adjustable relative to the main frame, whereby said drive levers are simultaneously properly positioned with respect to said cam shaft.

* * * * *